US010946553B1

(12) United States Patent
Lanclos et al.

(10) Patent No.: US 10,946,553 B1
(45) Date of Patent: Mar. 16, 2021

(54) AIRBORNE DUST MITIGATION SYSTEM

(71) Applicants: Christopher P. Lanclos, Kemah, TX (US); Hunter Whatley, Kemah, TX (US)

(72) Inventors: Christopher P. Lanclos, Kemah, TX (US); Hunter Whatley, Kemah, TX (US)

(73) Assignee: Refractory Construction Services Co. LLC, Deer Park, TX (US)

( * ) Notice: Subject to any disclaimer, the term of this patent is extended or adjusted under 35 U.S.C. 154(b) by 0 days.

(21) Appl. No.: 16/380,495

(22) Filed: Apr. 10, 2019

(51) Int. Cl.

| | |
|---|---|
| ***B28C 7/00*** | (2006.01) |
| ***B01F 3/12*** | (2006.01) |
| ***B01F 15/00*** | (2006.01) |
| ***B28C 7/16*** | (2006.01) |

(52) U.S. Cl.
CPC ..... *B28C 7/0007* (2013.01); *B01F 3/1228* (2013.01); *B01F 15/00961* (2013.01); *B01F 15/00974* (2013.01); *B28C 7/16* (2013.01); *B01F 2215/0047* (2013.01)

(58) Field of Classification Search
CPC ..... B01F 3/1228; B01F 15/00961; B01F 2215/0057; B28C 7/0007; B28C 7/16
See application file for complete search history.

(56) References Cited

U.S. PATENT DOCUMENTS 6,491,070 B1 * 12/2002 Espina Frutos ..... B01D 45/00 141/285

* cited by examiner

*Primary Examiner* — Anshu Bhatia
(74) *Attorney, Agent, or Firm* — Bushman Werner, P.C.

(57) ABSTRACT

A system for use with a gunite rig to capture airborne gunite type materials, particularly those containing silica, during the preparation of the gunite. In one respect, as the bags of silica-containing material are placed in the mixing section of the gunite rig and ripped open, airborne gunite dust is captured by a hood and suction system positioned above the mixer. Further, the mitigation system includes a plenum box and suction system positioned adjacent the mouth of a gunite pot to capture gunite dust generated as the mixed gunite material falls from a hopper into the gunite pot.

8 Claims, 3 Drawing Sheets

AIRBORNE DUST MITIGATION SYSTEM

FIELD OF THE INVENTION

The present invention relates to the mitigation of airborne dust and, more particularly, to silica dust generated in the preparation of silica-containing refractory compositions used in forming heat refractory surfaces, e.g., to the insides of vessels such as reactors, crackers, furnaces, etc.

BACKGROUND OF THE INVENTION

Reaction vessels, catalytic crackers, furnaces, and like vessels are commonly lined with a refractory material because of the high temperatures which can occur in the vessels. In particular, once such refractory lining commonly used contains silica powder which is considered by the Occupational Safety and Health Administration (OSHA) to be quite harmful when inhaled. Accordingly, in operations where a silica-containing refractory material is being prepared for use in lining a vessel, precautions must be taken to reduce the amount of airborne silica dust.

A typical trailer mounted rig (gunite rig) for preparing a silica-containing refractory material comprises a mixing chamber for mixing and wetting the ingredients of the gunite/shortcrete material (gunite), and a conveyor for transferring the mixed gunite material to a hopper, the hopper having bottom gates which are manually opened as needed to discharge a fixed amount of gunite material into a pressurized gunite pot, the gunite pot being connected to a hose which in turn is connected to a nozzle for applying the mixed gunite to the walls of the vessel to be lined.

There are two steps which occur on the gunite rig which can generate significant amounts of airborne solids, e.g., silica dust. The mixer is generally an open box-like structure having a grate under which is rotatably mounted a paddle mixer. A serrated cutter is mounted in the mixer and extends above the grate. Sacks of the silica-containing gunite are manually dumped on the grate, the bags being cut open by the cutter. The gunite is mixed with water to form a flowable, wetted gunite. In this step, when the bags are being cut open, a significant amount of airborne dust containing silica is released. As a safety precaution, the worker is equipped with a mask or other such equipment to alleviate inhalation of the airborne dust. Nonetheless, using prior art systems a significant amount of airborne dust is released from the mixer into the atmosphere. This release of airborne silica dust to the atmosphere is partially mitigated by the fact that the trailered rig, and the workers operating the rig, are in a temporary enclosure which is under some suction to recover the airborne dust in the enclosure. However, it would clearly be advantageous to keep the airborne dust generated when the bags are opened from entering the enclosure in the first place.

The second dust generating step which occurs on the gunite rig is when the mixed/wetted gunite is released from the hopper into the pot to which the gunite nozzles are attached. Again, in this step a significant amount of airborne dust (silica) can escape into the enclosure.

SUMMARY OF THE INVENTION

In one aspect, the present invention relates to the mitigation of airborne dust generated in gunite and shortcrete generation operations.

In another aspect, the present invention relates to the mitigation of airborne silica dust present in gunite/shortcrete materials used to form refractory walls on vessels.

In a further aspect, the present invention relates to a system for mitigating the dispersion into the atmosphere of silica-containing dust, capturing it at its point of generation.

In still a further aspect, the present invention relates to a system for mitigating the dispersion of silica-containing dust into the atmosphere which can be retrofitted to existing gunite rigs.

These and further features and advantages of the present invention will become apparent from the following detailed description, wherein reference is made to the figures in the accompanying drawings.

DETAILED DESCRIPTION OF PREFERRED EMBODIMENTS

Figure 1:
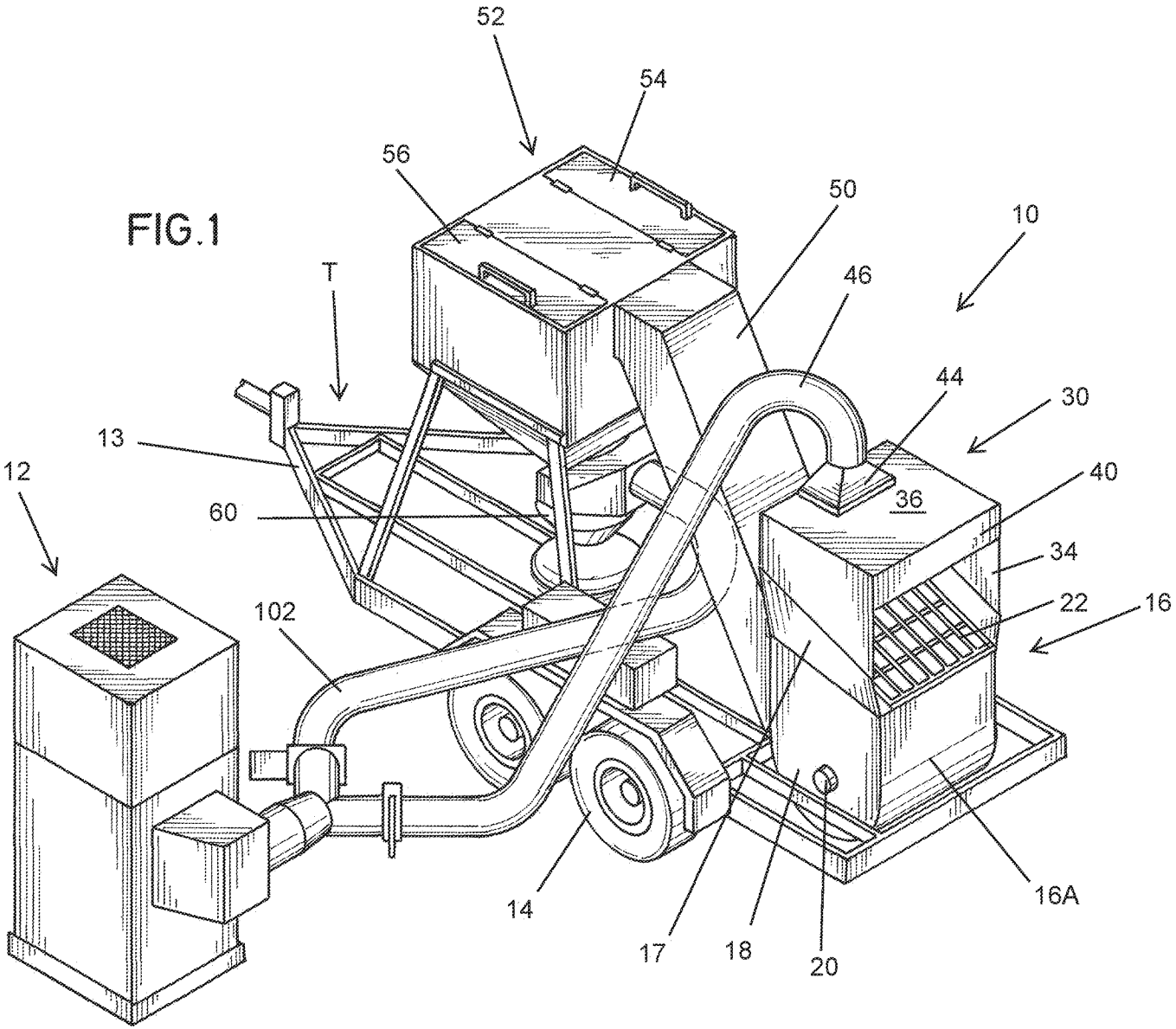
FIG. 1 is a perspective view of a gunite rig in accordance with one embodiment of the present invention.

Referring first to FIG. 1, there is shown a gunite rig 10 equipped with the dust mitigation system according to one embodiment of the present invention. The mitigation system shown in FIG. 1 comprises a trailered gunite rig, shown generally as 10, which is connected by hoses, described more fully hereafter, to a dust collection unit shown generally as 12. Gunite/shortcrete trailer rigs and their operation are well known to those skilled in the art. For example, gunite rigs marketed by Allentown Shotcrete Technology, Inc., a Putzmeister Company, are widely used around the world, their operation being well understood in the application of refractory linings to vessels and similar applications.

Figure 5:
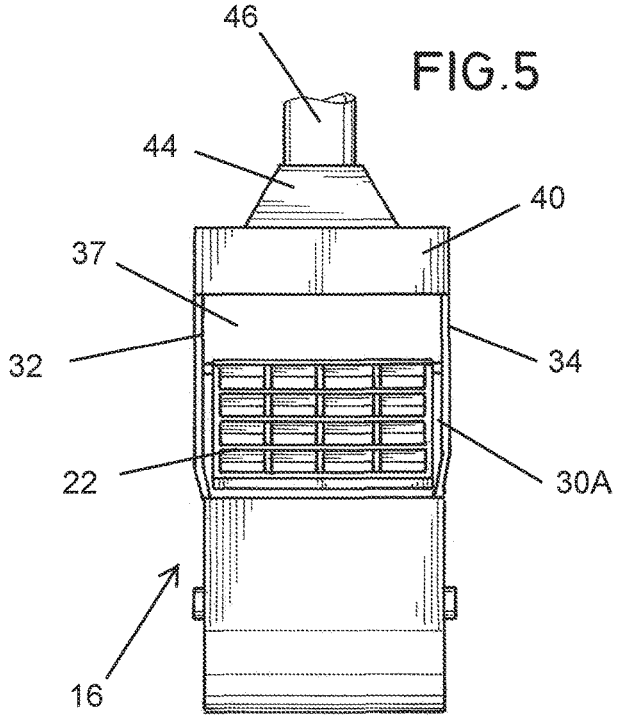
FIG. 5 is a front, elevational view of the system shown in FIG. 4.
Figure 6:
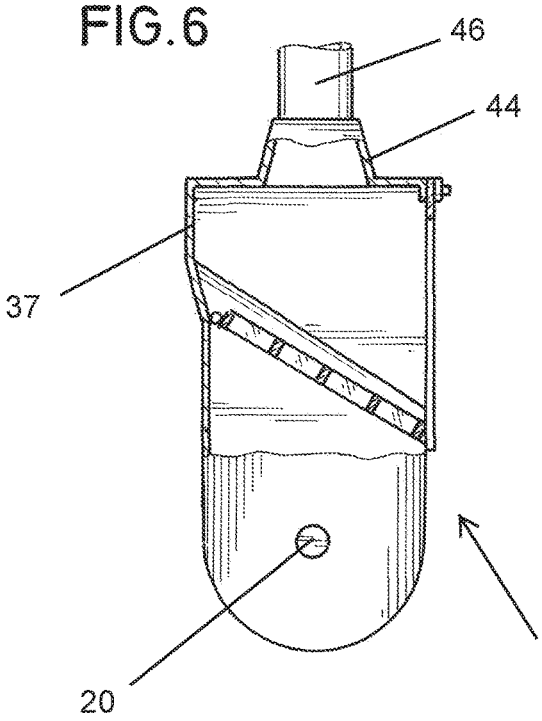
FIG. 6 is a view similar to FIG. 4, showing another embodiment of the dust mitigation system of the present invention.

Gunite rig 10 comprises a trailer, shown generally as T, comprising a frame 12 to which are connected wheels 14. Accordingly, the unit is portable and can be moved from location to location as needed. Mounted on trailer 10 is a gunite mixer of a type well known to those skilled in the art. Mixer 16 comprises a box-like structure 18 in which are mounted paddles (not shown) rotatably mounted on a driven axle 20. Mixer 16 has a grate 22 which can be provided with serrated blades or the like (not shown) for a purpose hereinafter described. Mounted on mixer 16 is a hood shown generally as 30 which comprises first and second spaced side walls 32 and 34, respectively, a top wall 36, and a back wall 37 (see FIGS. 5 and 7), side walls 32, 34 and the back wall 37 abutting parapet wall 17 extending upwardly from mixer 16. A lip 40 extends downwardly from the front edge of top wall 36, the lip 40 together with side walls 32 and 34 defining an opening into the mixer 16 above the grate 22. A vent 44 is connected to the top wall 36 of hood 30, vent 44 in turn being connected by a hose 46 by suitable plumbing and connections to dust collector 12 which provides a vacuum and filter system.

As is well known to those skilled in the art, bags of gunite material which frequently contains silica in some particulate form, are placed on the grate 22 where the serrated blade or cutter referred to above rips them open, the gunite material falling into the lower, mixing section 16A of mixer 16 where it is wetted with water and mixed using the paddle mixer noted above. In this operation of opening the bags by ripping them with a cutter or the like, significant amounts of gunite dust, e.g., silica, become airborne and can escape into the atmosphere. In this step, silica dust generation is substantially eliminated by use of a first dust mitigation system comprising hood 16, the hose 40, and dust collector 12. In this regard, the dust collector 12 provides a source of suction/vacuum such that dust or airborne material generated when the bags are opened on grate 22 is prevented from migrating into the surroundings by hood 30 in combination with the suction provided by dust collector 12 which effectively draws dust generated as the bags are opened through vent 44 and hose 46 to dust collector 12 where the dust is filtered out and substantially dust-free air is released.

Figure 2:
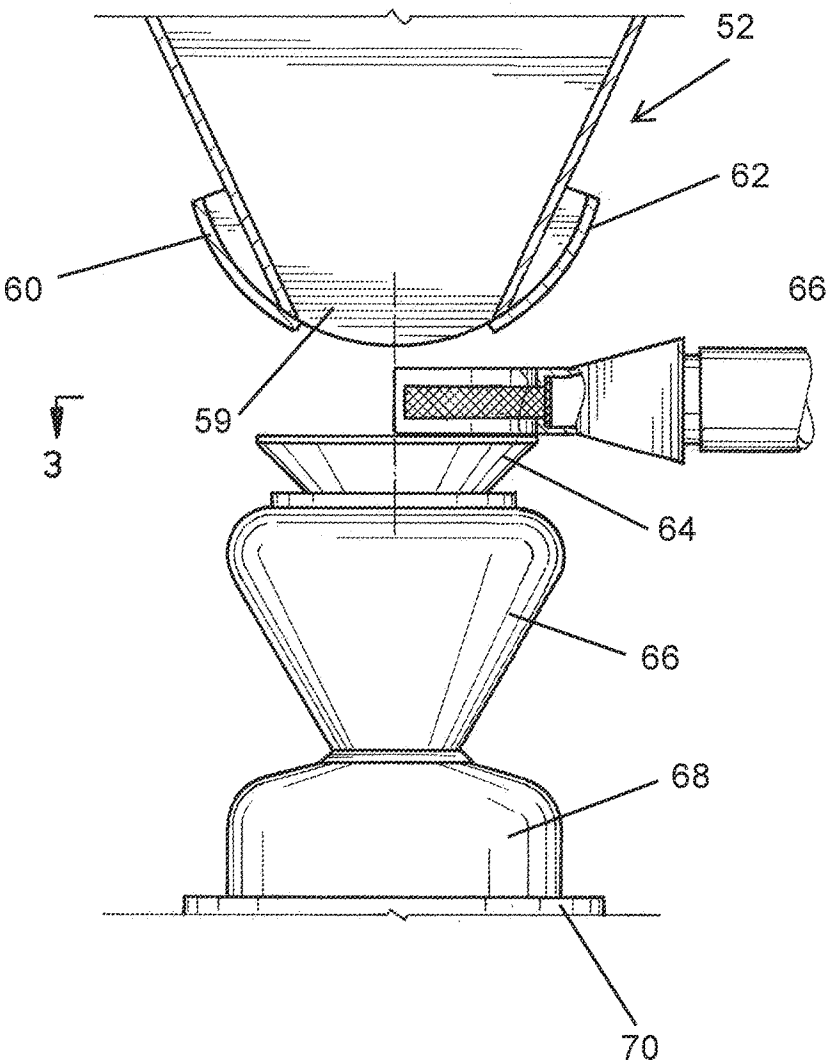
FIG. 2 is an elevational view of a portion of the gunite rig of FIG. 1 showing a first dust abatement system according to one embodiment of the present invention.
Figure 4:
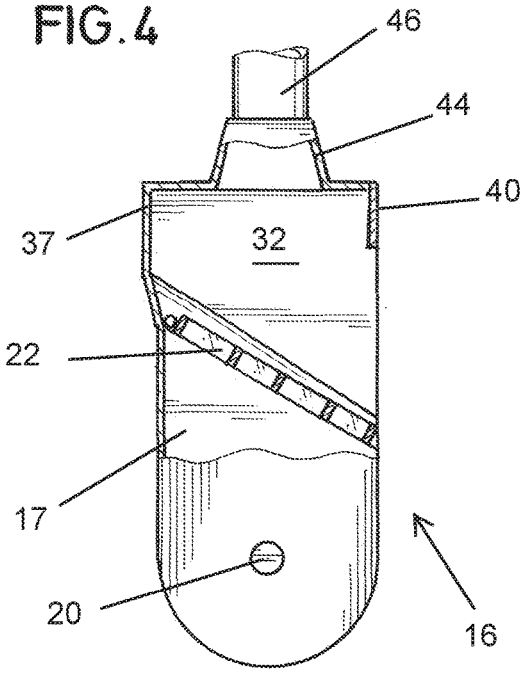
FIG. 4 is a side, elevational view of a portion of the gunite rig of FIG. 1 showing a second dust abatement system according to another embodiment of the present invention.

As noted above, in mixer 16 the gunite material is wetted and mixed. The wetted gunite is transferred via a conveyor 50 to a hopper 52 having top doors 54 and 56. As best seen in FIG. 2, hopper 52 has a bottom opening 59 which, when gates 60 and 62 are in the open position as shown in FIG. 2, allows a desired amount of wetted gunite material to fall downwardly through a funnel-shaped mouth 64 formed on top of a pot 66 which in turn is in selectively open communication with a sump 68. As is well known to those skilled in the art, when the gunite is being used to form a refractory surface on a vessel wall, the pot 66 and sump 68 are pressurized, sump 68 being connected to a transfer hose (not shown) which in turn is connected to a gunite nozzle (not shown) in a well-known manner.

Figure 3:
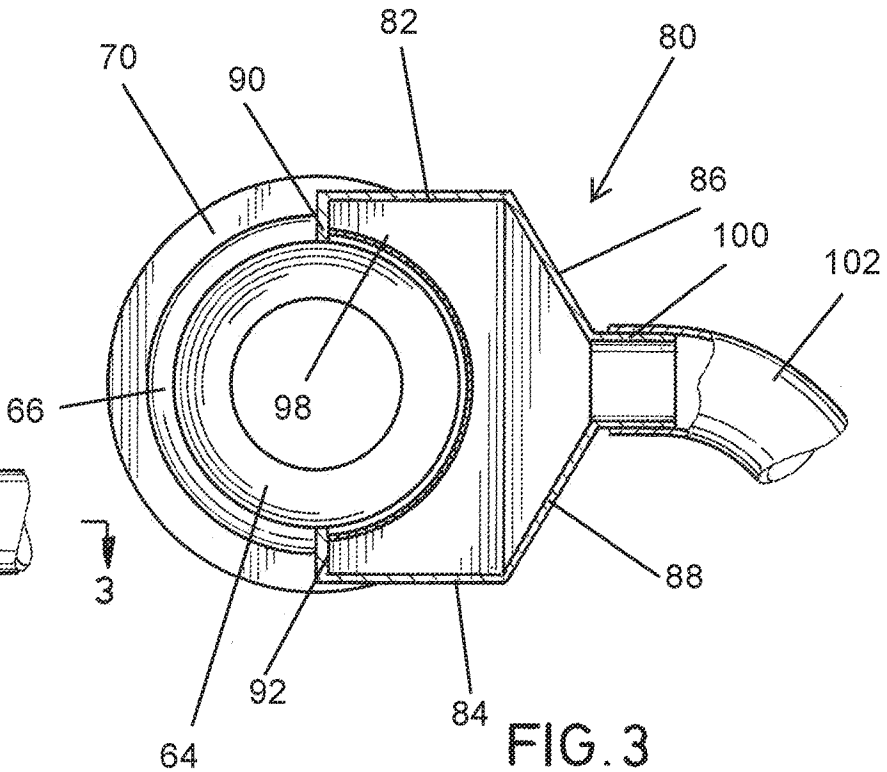
FIG. 3 is a cross-sectional view taken along the lines 3-3 of FIG. 2.

With reference to FIGS. 1-3, and as noted above, when gates 60 and 62 of hopper 52 are opened, gunite falls into funnel-shaped mouth 64 and since the gunite is merely wetted as opposed to being a slurry, a significant amount of airborne dust (silica) is generated in the space between hopper 52 and pot 66. Left unchecked, this dust escapes into the temporary enclosure in which the gunite rig is positioned. As noted, this creates hazardous conditions for workers, the dangers of silica dust being well known. To alleviate and substantially eliminate this dust from becoming airborne in the air surrounding the gunite rig, a plenum box shown generally as 80 is positioned in at least partial surrounding relationship to funnel-shaped mouth 64. Plenum box 80 has first and second side walls 82 and 84, angled rear walls 86 and 88, a bottom wall 90, and a top wall (not shown) which are connected to one another by end walls 92 and 94. There is a front wall 96 which is generally arcuate having substantially the same radius of curvature as funnel-shaped mouth 64. As also can be seen particularly with reference to FIGS. 2 and 3, front wall 96 is comprised of a screened intake which communicates with the interior of plenum box 80. Plenum box 80 at its rear end has a vent 100 which is connected to a hose 102, which in turn is connected by fittings to dust collector 12. Accordingly, when hopper gates 60 and 62 are opened, the wetted gunite material falls into pot 66, the dust which is generated being drawn in through the screened openings in front wall 96 of plenum box 80 and transferred via hose 102 to the dust collection apparatus 12. Thus, plenum box 80, vent 100, hose 102 and dust collection apparatus 12 comprise a second dust mitigation system.

It will be appreciated that dust collection apparatus 12 forms no part of the invention other than the fact that the airborne dust being removed from the gunite rig via hood 30 and plenum box 80 must be treated in some fashion to prevent it from being released to the atmosphere. Filtering is one of several methods to capture the dust. A suitable filtering system employs a Merv-15 Nanofiber Cartridge Filter.

Figure 7:
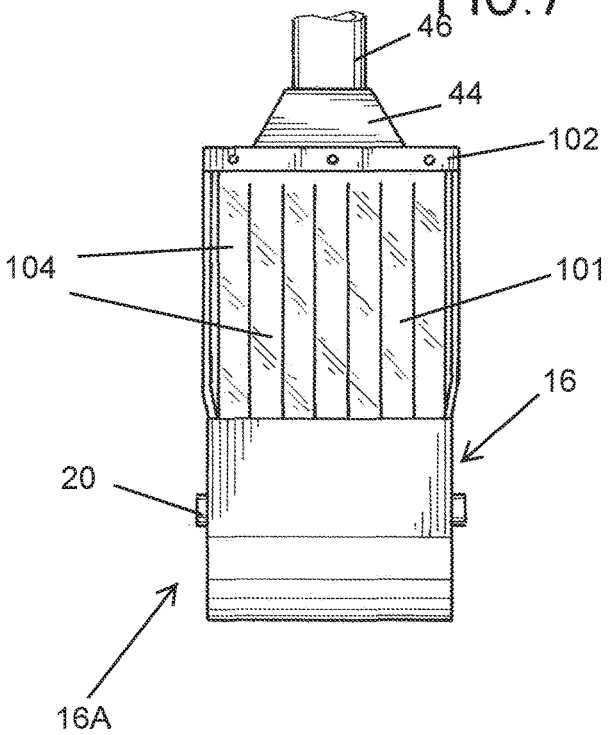
FIG. 7 is a front, elevational view of the dust mitigation system shown in FIG. 6.

Referring now to FIG. 7 there is shown another embodiment of the present invention. As discussed above and as best seen in FIG. 5, lip 40 of hood 30 extends downwardly to form a semi-constricted opening 30A into mixer 16. Nonetheless, even with the vent hood system of the present invention, particularly if there is ambient wind blowing in the area surrounding mixer 16, some dust might escape into the atmosphere. This problem is largely if not fully eliminated by the embodiment shown in FIG. 7. As seen, instead of lip 40, a strip curtain 101 is attached by a hanger strip 102 which is attached by bolts, rivets, or the like to a small lip (not shown) extending downwardly from the front end of top wall 36. As seen, curtain 101 comprises a plurality of individual strips 104 which extend downwardly to the bottom of opening 30A and generally close to side walls 32 and 34. It will be appreciated that with strip curtain 101, the bags of gunite material can be easily passed through the individual strips 104 and placed on the grate 22 where a cutting element (not shown) can cut the bags open and allow the gunite material to fall to the bottom portion 16A of mixer 16.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for capturing airborne particles from a gunite preparation apparatus, said apparatus comprising a mixer for mixing the gunite ingredients to form a gunite end product, a transfer system for moving the gunite end product to a hopper, a pot positioned below said hopper and having an axially upwardly facing mouth for receiving gunite product from said hopper, said system comprising:

a vent hood adapted to be positioned over and mounted on said mixer, said hood comprising a first side wall, a second side wall, and a top wall having a first end and a second end;

a first conveying hose having a first end connected to said vent hood, and a second end being adapted to be connectable to a vacuum source;

a plenum box adapted to be positioned adjacent the mouth of said pot and having an arcuate intake; and a second conveying hose having one end connected to said plenum box and a second end being adapted to be connectable to a vacuum source.

2. The system of claim 1, wherein said vent hood further comprises a lip extending downwardly from said first end of said top wall between said first and second sides, said lip cooperating with said first and second sides to form an inlet into said hood above said mixer.

3. The system of claim 1, wherein said hood further comprises a strip curtain extending from said first end of said top wall and having first and second sides adjacent said first and second side walls, respectively.

4. The system of claim 1, wherein said plenum box has a back wall, a top wall, a bottom wall, and a front wall, said front wall having suction openings into said plenum box, said back wall, said front wall, said top wall, and said bottom wall being connected by first and second end walls.

5. The system of claim 4, wherein said front wall is arcuate, and has a radius of curvature approximately the same as the radius of curvature of said mouth.

6. The system of claim 4, wherein said second conveying hose is connected to said back wall of said plenum box.

7. The system of claim 1, wherein said first conveying hose is connected to said top wall of said vent hood adjacent said second end.

8. A system for capturing airborne particles from a gunite preparation apparatus, said apparatus comprising a mixer for mixing the gunite ingredients to form a gunite end product, a transfer system for moving the gunite end product to a hopper having an outlet, a pot positioned below said hopper and having an axially upwardly facing mouth for receiving gunite product from said hopper outlet, there being an air column between said hopper outlet and said mouth, said system comprising:

a vent hood adapted to be positioned over and mounted on said mixer, said hood comprising a first side wall, a second side wall, and a top wall having a first end and a second end;

a first conveying hose having a first end connected to said vent hood, and a second end being adapted to be connectable to a vacuum source;

a plenum box adapted to be positioned adjacent the mouth of said pot, said plenum box having an arcuate intake which at least partially surrounds said air column, said hopper outlet, and said mouth; and a second conveying hose having one end connected to said plenum box and a second end being adapted to be connectable to a vacuum source.

* * * * *